US005228161A

United States Patent [19]

Scatizzi

[11] Patent Number: 5,228,161

[45] Date of Patent: Jul. 20, 1993

[54] METHOD FOR CONTINUOUSLY PRINTING POLYCHROMATIC DESIGNS, ESPECIALLY ON FABRICS AND THE LIKE, AND DEVICE FOR ITS REALIZATION

[75] Inventor: Mario Scatizzi, Pistoia, Italy

[73] Assignee: Tecnorama S.r.l., Florence, Italy

[21] Appl. No.: 803,462

[22] Filed: Dec. 6, 1991

[30] Foreign Application Priority Data

Dec. 7, 1990 [IT] Italy ..... 45523 A/90

[51] Int. Cl.[5] ..... D06B 1/02; D06B 11/00

[52] U.S. Cl. ..... 8/151; 8/158; 68/20; 68/22 R; 68/205 R

[58] Field of Search ..... 8/151, 158, 149; 68/19.1, 20, 22 R, 205 R

[56] References Cited

U.S. PATENT DOCUMENTS

| | | | |
|---|---|---|---|
| 3,393,411 | 7/1968 | McElveen | 68/205 R X |
| 3,750,567 | 8/1973 | Taguchi et al. | 68/19.1 X |
| 4,005,590 | 2/1977 | McLean | 68/205 R X |
| 4,141,231 | 2/1979 | Kudlich | 68/205 R |
| 4,254,644 | 3/1981 | Bartlett et al. | 68/205 R |
| 4,341,098 | 7/1982 | Otting | 68/205 R |
| 4,485,508 | 12/1984 | Otting | 68/205 R X |
| 4,601,727 | 7/1986 | Nichols, Jr. | 68/205 R X |
| 4,979,380 | 12/1990 | Robbins et al. | 68/205 R |

FOREIGN PATENT DOCUMENTS

| | | | |
|---|---|---|---|
| 1363724 | 8/1974 | United Kingdom | 68/205 R |

*Primary Examiner*—Philip R. Coe
*Attorney, Agent, or Firm*—McGlew and Tuttle

[57] ABSTRACT

To continuously print polychromatic designs on fabrics, a method is provided for horizontally moving the fabric with predetermined speed and direction, for drawing a prearranged amount of different colored liquid dyes, for applying the dyes of several colors to areas corresponding to predetermined adjacent points of the fabric in such a manner as to obtain particular chromatic effects due to the contemporaneous combination of several colors. The device comprises means for representing, on a video monitor, the image of the pictorial effect to be reproduced.

16 Claims, 2 Drawing Sheets

METHOD FOR CONTINUOUSLY PRINTING POLYCHROMATIC DESIGNS, ESPECIALLY ON FABRICS AND THE LIKE, AND DEVICE FOR ITS REALIZATION

FIELD OF THE INVENTION

The present invention relates in general to a method for continuously printing polychromatic designs on various materials, in particular woven carpets and the like, and a device for its realization.

BACKGROUND OF THE INVENTION

Similar known devices present the drawback that the printing of various colors is obtained in very distinct phases such that it is impossible to obtain particular chromatic effects in a small zone of the fabric due to the contemporaneous combination of several colors.

In other words, it is impossible to obtain particular tones or shades of colors using the above-mentioned known devices.

SUMMARY AND OBJECTS OF THE INVENTION

The primary scope of the present invention is to eliminate the above-mentioned drawback.

In accordance with the invention, this result is achieved by utilizing an operating method which involves:

- horizontally moving the fabric to be dyed with a prearranged speed and direction;
- drawing a predetermined amount of different colored liquid dyes from corresponding containers according to a prearranged sequence;
- injecting the prearranged sequence of dyes onto a prearranged print on the fabric to be dyed in areas corresponding to predetermined adjacent points.

In order to realize the method, a device is utilized which has:

- means for drawing a predetermined amount of liquid dyes from corresponding containers according to a prearranged sequence;
- means for injecting the drawn dyes on the fabric to be dyed;
- means for moving the fabric;
- means for supporting the means for injecting the dyes.

The advantages derived from the present invention essentially consist in that it is possible to attribute the desired tones and shades of color to the points of the fabric with remarkable precision and according to a prearranged layout, which makes it possible to obtain pictorial and chromatic effects completely similar to those obtained by painting the same fabric by hand, that is, with high aesthetic quality and remarkable qualitative contents.

These and further advantages and characteristics of the present invention shall be better understood by all persons skilled in the art from the description below and with the aid of the attached drawings, which is given as partial simplification of the invention, but not to be considered in a limiting sense.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
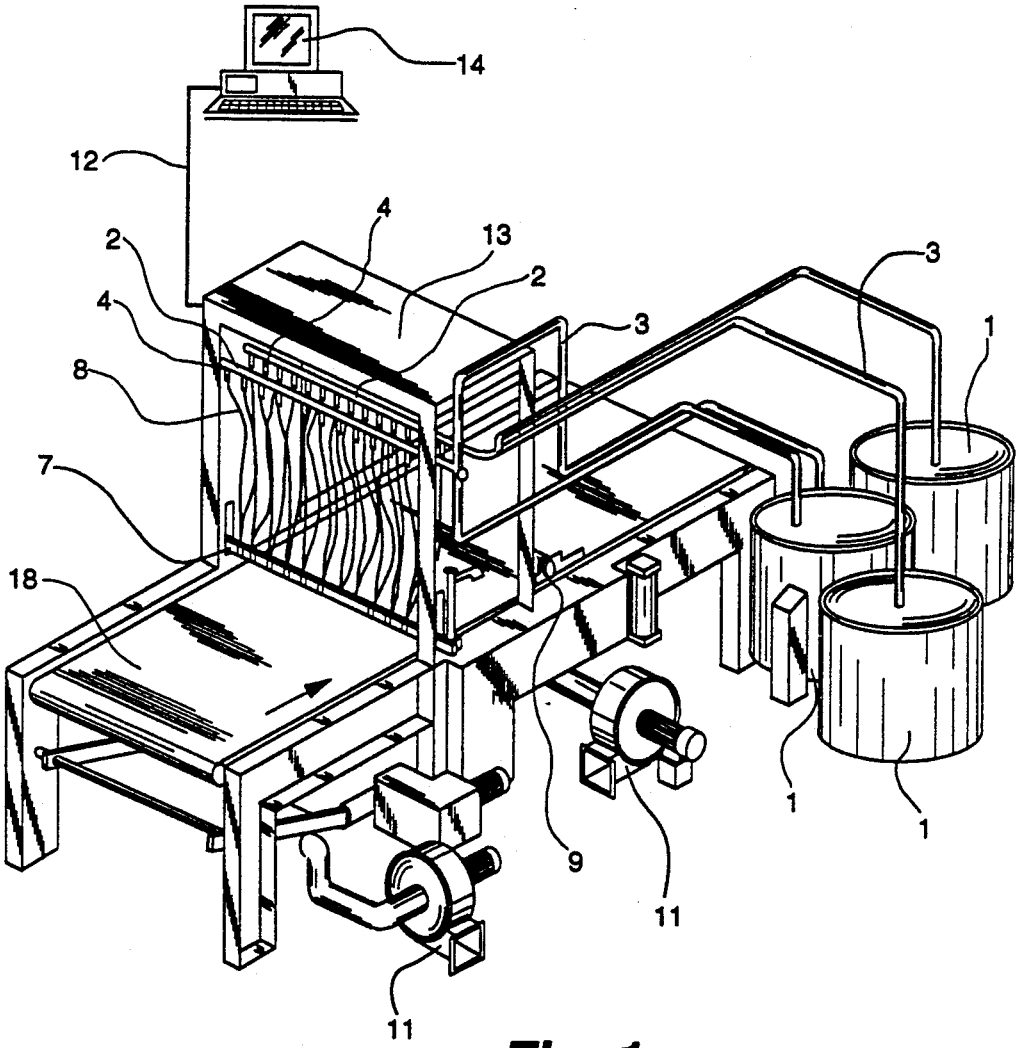
FIG. 1 represents a prospective view of a device for printing polychromatic designs in accordance with the invention.
Figure 2:
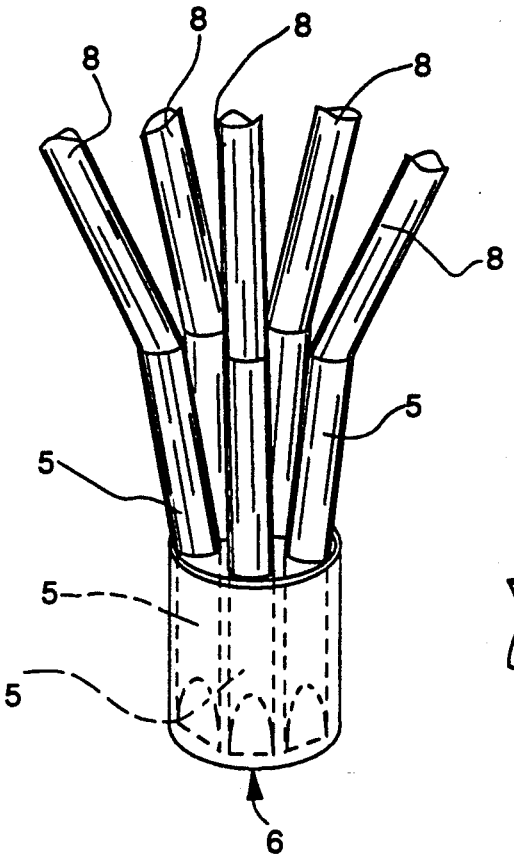
FIG. 2 represents a prospective view of the means for injecting dyes of the device in FIG. 1.
Figure 3:
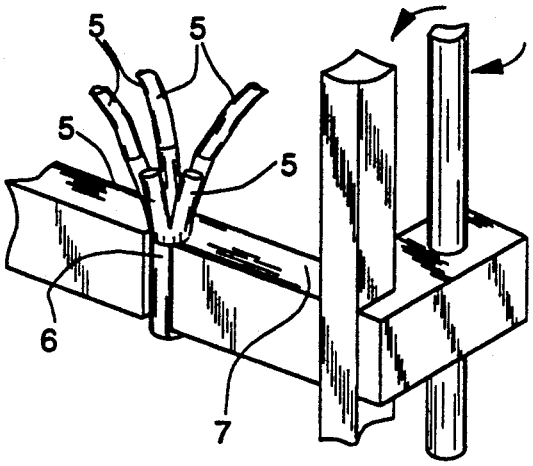
FIG. 3 represents a prospective view of the means in FIG. 2 in arrangement of use.

Reduced to its essential structure and with reference to the figures in the attached drawings, the method, according to the invention, for continuously printing polychromatic designs, has the following order of operating phases:

- moving the fabric to be dyed with a prearranged speed and direction;
- drawing a predetermined amount of different colored liquid dyes from corresponding containers according to a prearranged sequence;
- injecting the prearranged sequence of dyes onto a prearranged print on the fabric in areas corresponding to predetermined adjacent points; and repeating the above steps to form a polychromatic design.

Advantageously, in accordance with the invention, it is provided that, after the phase of injecting the dyes, the cleaning of the dyed fabric or the setting of the injected color takes place. Thus, it is also provided that the image of the pictorial effect to be reproduced on the fabric is represented on a video monitor.

In accordance with the invention, to realize the method, the device provides:

- means 3 for drawing a predetermined amount of liquid dyes of various colors from corresponding containers 1 according to a prearranged sequence;
- means 2, 4, 5, 6, 8 for injecting the drawn dyes, on the fabric to be dyed, in areas corresponding to prearranged adjacent points;
- means 12 for moving the fabric with a prearranged speed and direction;
- means 9, 13 for supporting the above-mentioned means 2, 4, 5, 6, 8 for injecting the dyes.

According to a preferred embodiment of the invention, the means for drawing the liquid dyes from the respective containers 1 comprise connection tubes 3 between the containers 1 and corresponding distribution collectors 2 which supply the dyes to a plurality of multiple nozzles 6 . Each container has its own color and its own distribution collector 2. Each distribution collector 2 is aligned transversely with, respect to the sliding direction of the fabric to be dyed. Each multiple nozzle 6 is provided with several injectors 5. Each injector 5 of a nozzle 6 is connected to a different distribution collector 2 and receives a different color. Correspondingly each injector 5 injects a single color corresponding to a prearranged point of the material to be treated. FIG. 1 shows the invention with two colors, two connection tubes 3 and two distribution collectors 2. Correspondingly each nozzle 6 will have two injectors 5 and be able to combine the two colors in different portions to form a plurality of different shades of color on the fabric. Moreover, the means for the movement of the fabric preferably comprise a horizontal belt 12 which slides below the injectors 5.

The transfer of the dyes to the distribution collectors 2 can be advantageously carried out by means of pumps. Thus, the transfer can also advantageously be of the pressure type as well as the free drop from above type.

It is advantageously provided that the number of injectors 5 comprised in a multiple nozzle 6 is equal to the number of liquid dyes stored in the containers 1, thus making it possible to obtain any combination of the available colors at a prearranged point of the fabric according to prearranged proportions.

Moreover, it is advantageously provided that the supply of the liquid dyes to the multiple nozzles is regulated by means of a plurality of electrovalves 4 provided for each injector 5. The opening and closing times of which are controlled by means of an electronic control unit, for simplification not shown in the figures. Each of the electrovalves 4 being advantageously connected to its corresponding injector 5 by means of pipes 8. A support means for the connection tubes 3, and distribution collection 2 also has a rack 7 for accommodating the nozzles 6, which makes it possible to insert and unthread the nozzles 5 with extreme facility for providing their maintenance or replacement. The nozzles 6 are lined along the rack 7, and the rack 7 is positioned across the fabric. Each nozzle 6 has a plurality of injectors 5, and each injector 5 carries a different color from the container 1. A whole line across the fabric can then be covered with a plurality of different color combinations. It is also advantageously provided that an electronic exchange 12 is interfaced with a digital computer 14 for monitoring the course of the operating phases of the present method.

Moreover, means 10 for drying the belt 12 are provided upstream from the line of multiple nozzles 6, and means 9 for squeezing the treated material to facilitate the penetration of the color are provided downstream from the nozzles 6. To facilitate the cleaning of the fabric, means 11 for suctioning the excess colors are also provided downstream from the nozzles 6.

Moreover, display means are advantageously provided for representing, on a video monitor of the digital computer 14, the image of the pictorial effect to be reproduced on the fabric.

The operation is as follows:

An electronic unit administers the drawing of the dyes from the respective containers 1 according to a prearranged amount and according to prearranged colors. The dyes thus drawn are transferred to the distribution collectors 2, and the flow is regulated by means of the opening and closing of the electrovalves 4. Opening and closing times are controlled by a preprogrammed electronic unit. Since each injector 5 is linked with a different color conduit, it is possible to inject a prearranged amount of any desired color or color tone corresponding to a predetermined point on the fabric, by combining the colors proceeding from the above-mentioned conduits in the prearranged proportions. Therefore, at a predetermined point on the fabric, a polychromatic effect is obtained which may be different from that obtained other points of the same fabric by means of the injectors 5 of the other nozzles 6.

In practice, the details of execution can, however, vary in an equivalent manner in the shape, dimensions, arrangement of the elements, and type of materials used, without, moreover, going beyond the scope of the idea of the solution adopted and therefore remaining within the limits of the protection granted to the present patent for this invention.

What is claimed is:

1. A method for printing polychromatic designs on a fabric, the method comprising the steps of:

drawing and keeping separate predetermined amounts of a plurality of different colors of dye, a mixture of said predetermined amounts of said plurality of different colors of dye forming a desired color;

transporting each of said predetermined amounts of said plurality of different colors of dye to corresponding injectors;

combining said injectors corresponding to each of said plurality of different colors into a nozzle;

spraying said predetermined amounts of said dye out of each of said injections and into said nozzle;

mixing said predetermined amounts of said plurality of different colors of dye in said nozzle to form a desired dye in said desired color;

spraying said desired dye out of said nozzle and onto the fabric;

moving the fabric relative to said nozzle for applying said sprayed desired dye onto a predetermined point on the fabric; and repeating above said steps to form the polychromatic design.

2. A process in accordance with claim 1, further comprising:

removing an excess of said sprayed dyed from the fabric in order to clean the fabric.

3. A process in accordance with claim 2, further comprising:

said removing of said excess of said sprayed dye is preformed by a suction device.

4. A method in accordance with claim 1, further comprising:

providing a belt to move the fabric.

5. A device in accordance with claim 4, further comprising:

drying said belt prior to applying said drawn predetermined amount of said plurality of different colors of dye.

6. A method in accordance with claim 5, wherein:

said drying is preformed by a suction of air corresponding to a lower portion of said belt.

7. A device for printing polychromatic designs on a fabric, the device comprising:

drawing means for drawing predetermined amounts of a plurality of different colors of dye from a corresponding plurality of containers according to a predetermined sequence;

injection means for combining said predetermined amounts of dye into a desired color and then spraying said combined dye onto a predetermined point of the fabric;

movement means for moving the fabric relative to said injection means in order to have said injected predetermined amounts to be applied to predetermined points on the fabric; and support means for supporting the injection means.

8. A device in accordance with claim 7 wherein:

said drawing means has a connection tube leading from each of said plurality of containers, and said drawing means also having a plurality of distribution collectors connected to each of said connection tubes;

said injecting means having a plurality of nozzles, each of said plurality of nozzles having a plurality of injectors corresponding to said plurality of different colors, said plurality of nozzles being aligned transversely to the fabric;

electrovalve means between each of said plurality of injectors and said distribution collector, for regulating predetermined amounts of said dye from said distribution collectors to said plurality of injectors, said electrovalve means being connected to said injectors by means of pipes; and an electronic monitoring and control means for controlling opening and closing said electrovalve means with predetermined opening and closing times.

9. A device in accordance with claim 7, wherein:

said movement means has a belt which supports the fabric and moves the fabric relative to said injection means.

10. A device in accordance with claim 9, further comprising:

suction means for drying said belt.

11. A device in accordance with claim 7, wherein:

said support means has a rack for accommodating said plurality of nozzles.

12. A device in accordance with claim 7, further comprising:

squeezing means for squeezing the fabric applied with said predetermined amounts of said dye.

13. A device in accordance with claim 7, further comprising:

excess dye cleaning means for suctioning an excess of said predetermined amounts of said dye from the fabric in order to clean the fabric.

14. A device in accordance with claim 7, further comprising:

video monitor means for representing an image of the polychromatic design to be printed on a fabric.

15. A device for printing polychromatic designs on a fabric, a device comprising:

a plurality of valve means for drawing individual predetermined amounts of a plurality of different colors of dye;

a plurality of injection means, each of said injection means connected to a respective one of said valve means, and for spraying respective predetermined amounts of dye from said respective valve means;

plurality of nozzle means, each nozzle means for combining a set of said plurality of injection means, each set of injection means including individual injection means corresponding to different dyes, said nozzle means also for combining said sprayed predetermined dye from each of said individual injection means in a respective said set to form a desired color;

movement means for moving the fabric relative to said plurality of nozzle means in order to have said sprayed predetermined amounts of dye to be applied to predetermined points on the fabric; and support means for supporting plurality of nozzle means.

16. A device in accordance with claim 15, further comprising:

a plurality of distribution collectors connected to said plurality of valve means, each of said plurality of distribution collectors corresponding to individual dyes;

a plurality of containers supplying said individual dyes to respective distribution collectors by connection tubes; and an electronic monitoring and control means for controlling opening and closing said plurality of valve means to create said desired color in each of said nozzle means.

* * * * *